US005205259A

United States Patent [19]

Clarke et al.

[11] Patent Number: 5,205,259

[45] Date of Patent: Apr. 27, 1993

[54] MODIFIED CYLINDER HEAD

[75] Inventors: John M. Clarke, Chillicothe; James J. Faletti, Spring Valley; David E. Hackett, Washington, all of Ill.

[73] Assignee: Caterpillar Inc., Peoria, Ill.

[21] Appl. No.: 752,507

[22] PCT Filed: Aug. 30, 1991

[86] PCT No.: PCT/US91/06169

§ 371 Date: Aug. 30, 1991

§ 102(e) Date: Aug. 30, 1991

[51] Int. Cl.[5] ..... E02B 15/00

[52] U.S. Cl. ..... 123/432; 123/308; 123/302

[58] Field of Search ..... 123/302, 308, 432

[56] References Cited

U.S. PATENT DOCUMENTS

| | | | |
|---|---|---|---|
| 3,991,729 | 11/1976 | Notaro | 123/432 |
| 4,587,936 | 5/1986 | Matsuura et al. | 123/432 |
| 4,765,297 | 8/1988 | Richter | 123/432 |
| 4,766,866 | 8/1988 | Takii et al. | 123/432 |
| 4,932,377 | 6/1990 | Lyle | 123/432 |
| 4,938,192 | 7/1990 | Pusic et al. | 123/432 |
| 5,012,783 | 5/1991 | Ferrazzi | 123/432 |
| 5,018,497 | 5/1991 | Tsuchida | 123/432 |
| 5,119,785 | 6/1992 | Saito et al. | 123/432 |

OTHER PUBLICATIONS

SAE Technical Paper #910296 Entitled "The Effects of Intake-Flow configuration on the Heat-Release and Heat-Transfer Characteristics of a Single-Cylinder Four-Valve S. I. Engine" Dated Feb. 25-Mar. 1, 1991.

*Primary Examiner*—E. Rollins Cross
*Assistant Examiner*—Erick Solis
*Attorney, Agent, or Firm*—Diana L. Charlton

[57] ABSTRACT

Multiple intake valves operatively associated in a common combustion chamber are advantageous in that the design achieves high output for an internal combustion engine. The subject modified cylinder head utilizes the advantages available in a multiple intake valve system, but further enhances the design by reducing heat rejection. In the subject modified cylinder head, three intake valves (38,40,42) having corresponding intake valve ports (26,28,30) and one exhaust valve (68) having an exhaust valve port (66) are operatively associated in a common combustion chamber. A reduction in heat rejection is achieved through a relationship between the cross-sectional areas of the intake and exhaust valve ports (26,28,30,66). The intake valve ports (26,28,30) are constructed so that their cross-sectional area is larger than about 69% of the combined cross-sectional area of the intake and the exhaust ports (26,28,30,66).

6 Claims, 4 Drawing Sheets

MODIFIED CYLINDER HEAD

DESCRIPTION

1. Technical Field

This invention relates to internal combustion engines and more particularly to a modified cylinder head for the reduction of heat rejection thereof.

2. Background Art

It is well known in the art that a reduction of heat rejection from the combustion chamber of an internal combustion engine is an important step in increasing thermal efficiencies associated with the engine. Several advantages result from the increase in thermal efficiency, including: reduced fuel consumption, reduced cooling system requirements, and enhanced exhaust energy recovery effectiveness.

Multiple intake valves operatively associated in a common combustion chamber have been shown in prior art emphasizing the advantage of the design for achieving high output. The multiple intake valve designs fail to recognize the important relationship that exists between the cross-sectional areas of the intake and exhaust valve ports in reducing the heat rejection in an internal combustion engine.

It is the object of the present invention to recognize the advantages available in a multiple intake valve system while providing a design that will reduce the heat rejection, thereby increasing thermal efficiency of the engine.

DISCLOSURE OF THE INVENTION

The present invention provides a cylinder head adapted for use in an internal combustion engine for the reduction of heat rejection. The head includes an exhaust valve port means and an intake valve port means having effective cross-sectional areas. The cross-sectional area of the intake valve port means is larger than about 69% of the combined cross-sectional area of the intake and exhaust valve port means.

Another aspect of the present invention provides an internal combustion engine having a cylinder block that defines a bore. A cylinder head is attached to the cylinder block in closing relation to the cylinder bore. A piston is reciprocally mounted in the cylinder bore and defines with the cylinder block and the cylinder head a variable volume combustion chamber. An intake valve means is provided for admitting a constituent of a combustible mixture into the combustion chamber and an exhaust valve means is also provided for releasing exhaust gas from the combustion chamber. The present invention includes an exhaust valve port means, operatively associated with the exhaust valve means, and having an effective cross-sectional area. In addition to the exhaust valve port means, an intake valve port means, operatively associated with the intake valve means, is included having an effective cross-sectional area which is larger than about 69% of the combined cross-sectional area of the intake and exhaust valve ports means.

The present invention provides an improvement in the reduction of heat rejection by increasing the cross-sectional area of the intake valve to larger than about 69% of the combined cross-sectional area of the intake and exhaust valve ports. The improved reduction of heat rejection will increase thermal efficiency of the engine thereby reducing fuel consumption and cooling capacity requirements while increasing exhaust energy recovery effectiveness.

BEST MODE FOR CARRYING OUT THE INVENTION

Figure 1:
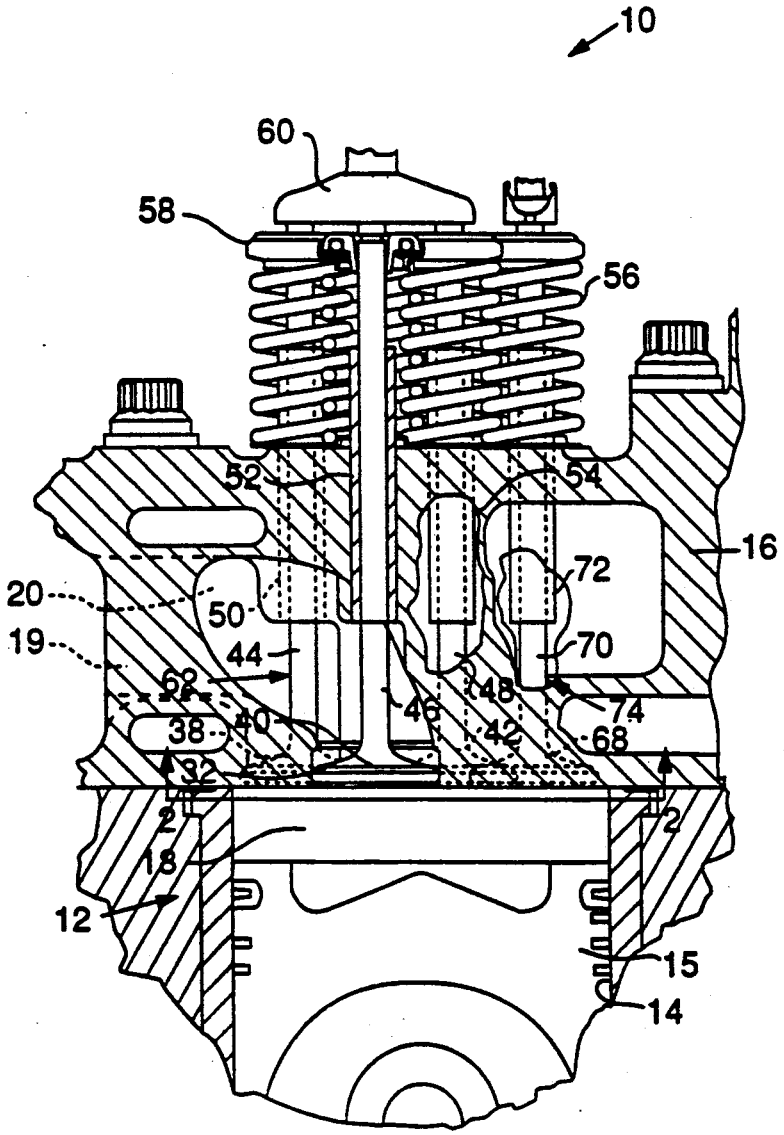
FIG. 1 is a sectional view taken along line 1—1 of FIG. 2 illustrating a cylinder head, valves, and valve arrangement of an internal combustion engine for the present invention.

An internal combustion engine 10 is illustrated in FIG. 1 and is constructed in accordance with an embodiment of the invention. Only a single cylinder has been illustrated and will be described. It should be understood, however, that the invention is capable of use in engines having multiple cylinders and any type of cylinder configuration.

The engine 10 includes a cylinder block 12 having a cylinder bore 14 in which a piston 15 reciprocates and which is connected by means of a connecting rod (not shown) to a crankshaft (not shown) for driving the crankshaft in a conventional manner.

Figure 2:
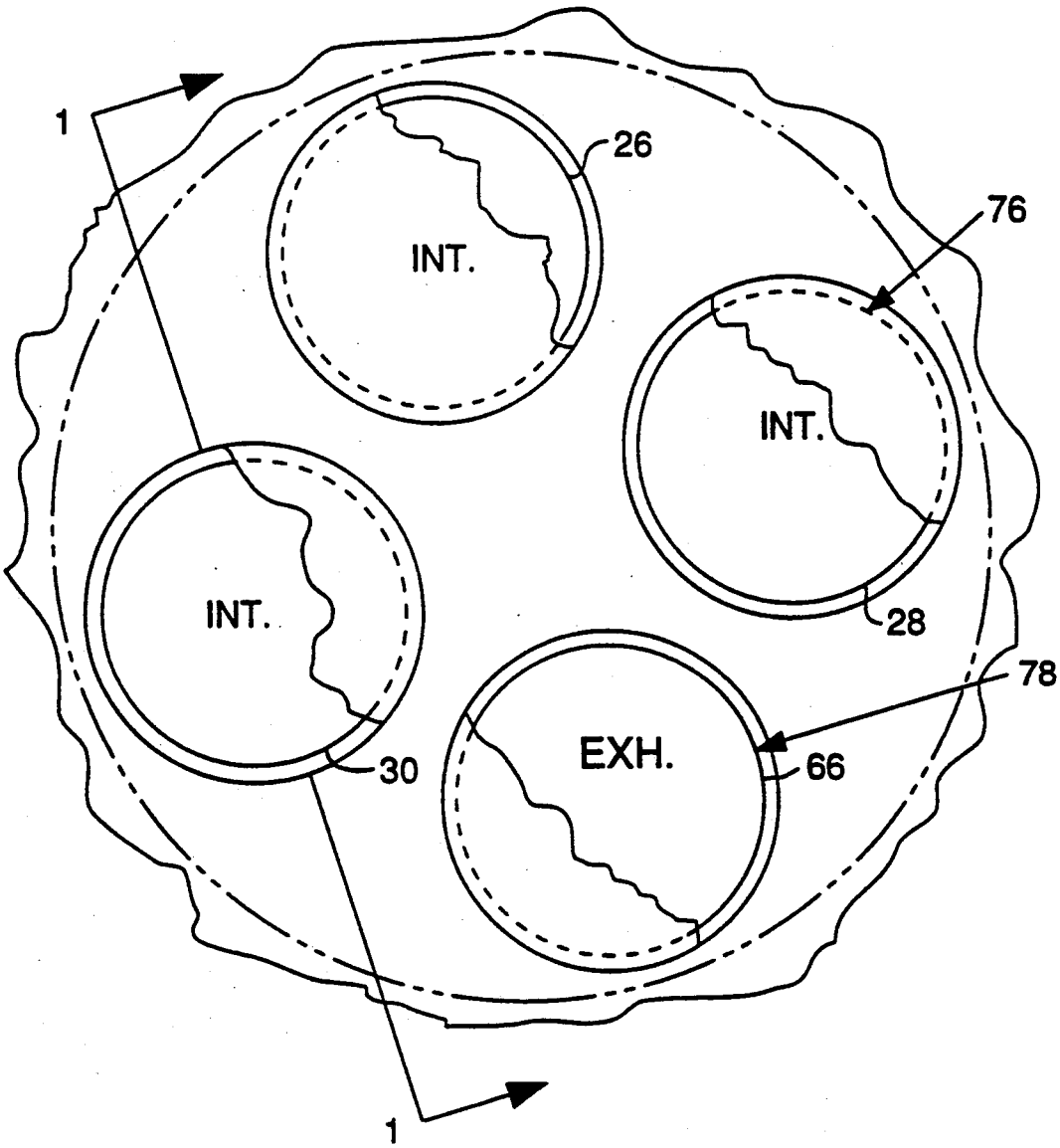
FIG. 2 is an enlarged diagrammatic view taken along line 2—2 of the valve porting arrangement showing the intake valve port cross-sectional area being about 75% of the combined intake and exhaust valve ports cross-sectional area.

A cylinder head 16 is affixed to the cylinder block 12 in closing relationship to the cylinder bore 14 in a conventional manner and cooperates with the cylinder bore 14 and the piston 15 to provide a variable volume combustion chamber 18. An intake passage 19 having three branches 20, 22, and 24, one of which is shown in FIG. 1, are formed in the cylinder head 16 and terminate at a plurality of associated intake valve ports 26, 28, and 30, having effective cross-sectional areas, respectively defined by the intake valve seats, one of which is shown at 32. By way of example, the intake valve ports 26, 28, and 30 shown in FIG. 2 have effective cross-sectional areas equal to 1090.4 $mm^2$ individually, and the combined effective cross-sectional area of the three intakes valve ports 26, 28, and 30 is 3271.2 $mm^2$. Three intake valves 38, 40, and 42, having respective stem portions 44, 46, and 48, are supported for reciprocation in the cylinder head 16 in a conventional manner, such as by valve guiding mechanisms 50, 52, and 54. Coil springs, one of which is shown at 56, encircle the intake valve stems 44, 46, and 48 and act against keepers, one at which is shown at 58, for urging the intake valves 38, 40, 42 to their closed position. An unguided bridge 60 may be used as shown in FIG. 1 to simultaneously actuate the three intake valves 38, 40, and 42 through any conventional manner, either electrically, mechanically, or hydraulically. The intake valves 38, 40, and 42 define an intake valve means 62 which controls the flow of a constituent of a combustible mixture, in this instance, air through the intake passages 20, 22, and 24 into the combustion chamber 18. An exhaust passage 64 is formed in the cylinder head and terminates at an associated exhaust valve port 66, having an effective cross-sectional area, defined by the exhaust valve seat similar to the intake valve seat shown at 32. By way of example, the exhaust valve port 66 shown in FIG. 2 has an effective cross-sectional area of 1090.4 $mm^2$. An exhaust valve 68, having a stem portion 70, is supported for reciprocation in the cylinder head 16 in a conventional manner, such as by a valve guiding mechanism 72. A coil spring, similar to the one shown at 56, encircles the exhaust valve stem 70 and acts against a keeper, similar to the one shown at 58, for urging the exhaust valve 68 to its closed position. The exhaust valve 68 defines an exhaust valve means 74 which controls the flow of the products of combustion from the combustion chamber 18 and through the exhaust passage 64. The intake valve ports 26, 28, and 30 constitute an intake valve port means 76 which is operatively associated with the intake valve means 62. The exhaust valve port 66 constitutes an exhaust valve port means 78 which is operatively associated with the exhaust valve means 74. The intake and exhaust valve ports 26, 28, 30, and 66 are diagrammatically illustrated in FIG. 2. The exhaust valve port means 78 may also include a plurality of exhaust valve ports 66 although not shown in the embodiments for the present invention. The combined effective cross-sectional area (3271.2 $mm^2$) of the intake valve ports 26, 28, and 30 is about 75% of the combined cross-sectional area (4363.6 $mm^2$) of the intake and exhaust valve ports 26, 28, 30, and 66.

Figure 3:
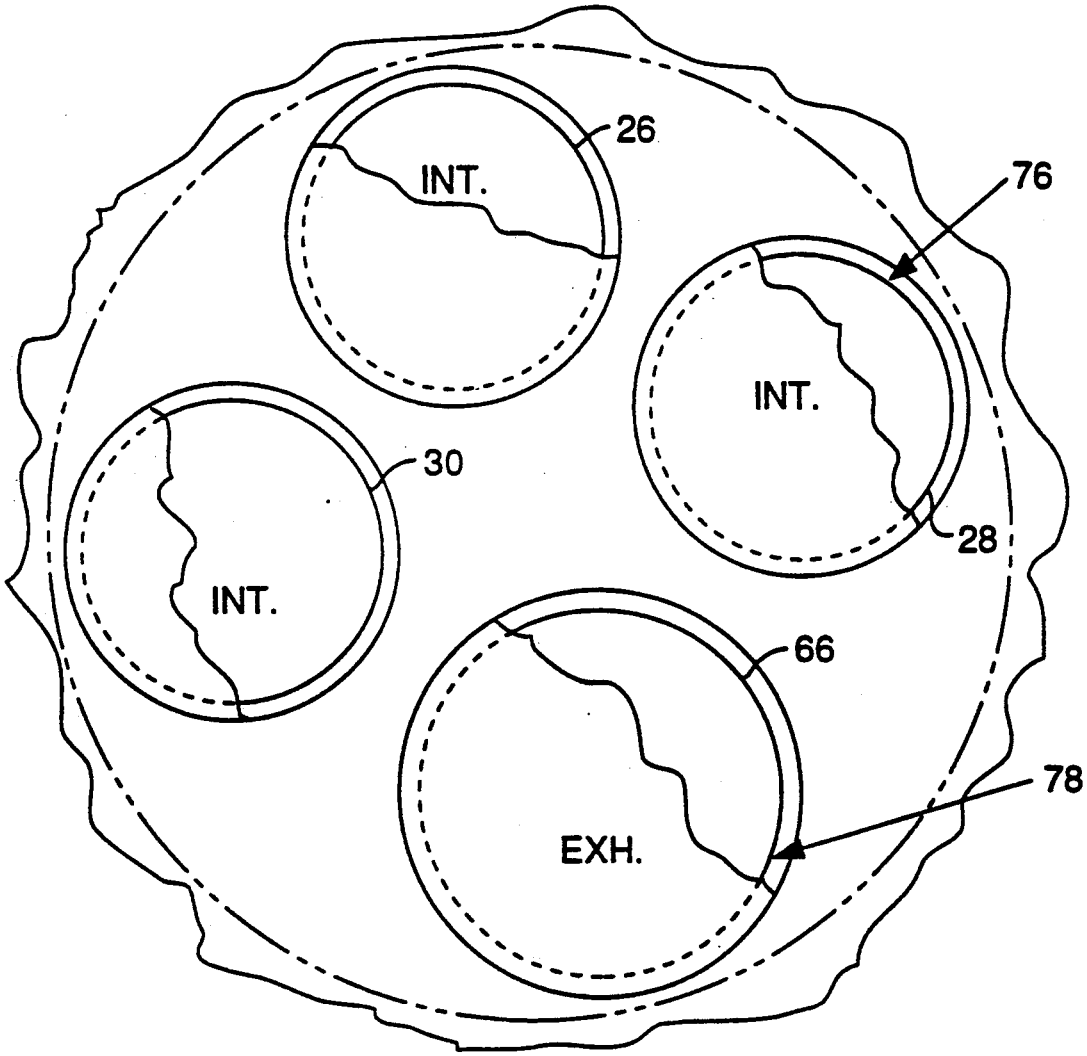
FIG. 3 is an enlarged diagrammatic view taken along line 2—2 of the valve porting arrangement showing the intake valve port cross-sectional area being about 70% of the combined intake and exhaust valve ports cross-sectional area.

Another embodiment of the present invention is disclosed in FIG. 3. It should be noted that the same reference numerals of the first embodiment are used to designate similarly constructed counterpart elements of this embodiment. In this embodiment the total effective cross-sectional area of the intake valve ports 26, 28, and 30 is about 70% of the combined cross-sectional area of the intake and exhaust valve ports 26, 28, 30, and 66.

Figure 4:
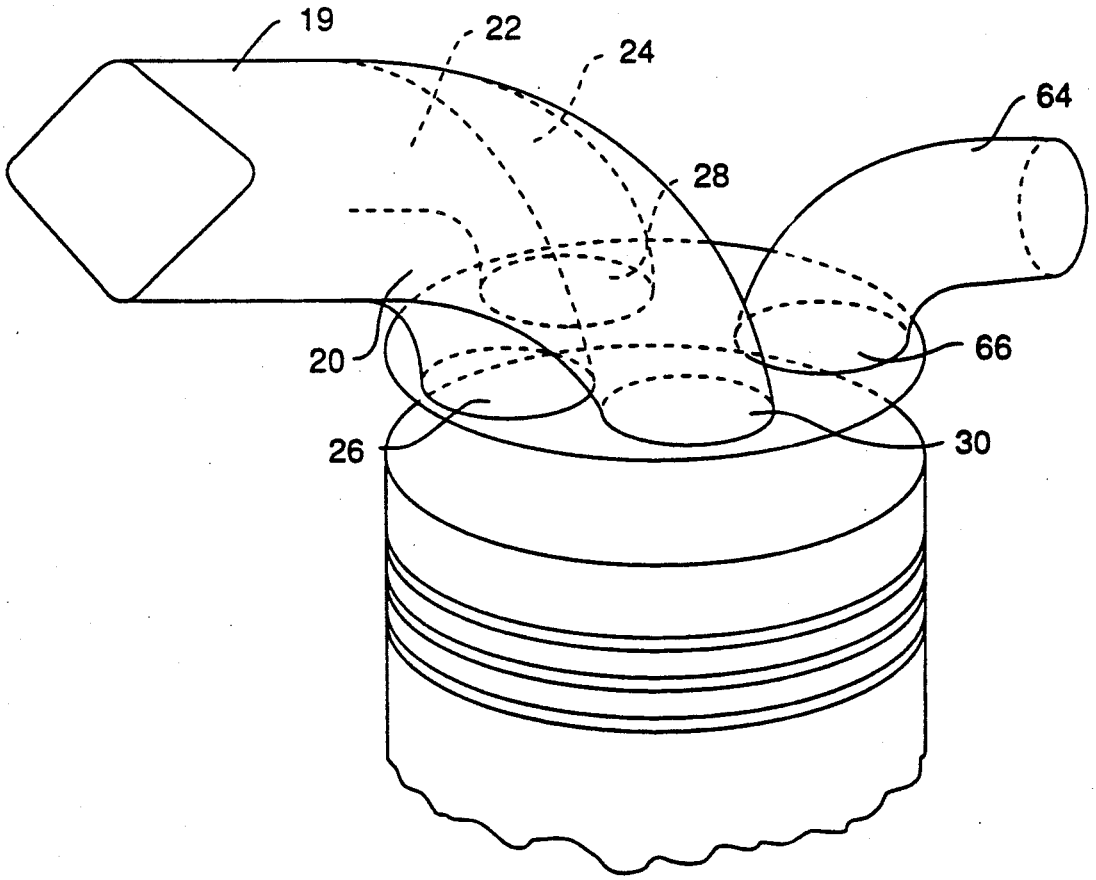
FIG. 4 is a schematic view in perspective form showing the configuration of the passages.

The intake passage 19 having three branches 20, 22, and 24 and the exhaust passage 64 are shown in FIG. 4 with their associated valve ports 26, 28, 30, and 66. It should be noted that the cross-sectional area of intake valve ports 26, 28, 30 should be larger than about 69% of the combined cross-sectional area of the intake and exhaust valve ports 26, 28, 30, and 66.

Industrial Applicability

A reduction in heat rejection is achieved through a relationship between the cross-sectional areas of the intake valve ports 26, 28, 30 and the exhaust valve port 66 providing an increase in thermal efficiency for an internal combustion engine. The intake valve ports 26, 28, 30 are constructed so that their cross-sectional area is larger than about 69% of the combined cross-sectional area of the intake and exhaust valve ports 26, 28, 30, 66.

It is known for a fluid, such as air, moving through a passage to have a layer of the fluid adjacent to the surrounding surface which has reduced flow velocities. This layer is the boundary layer and within this layer the flow velocities decrease as the surrounding surface is approached. The velocity of the fluid in immediate contact with the surrounding surface is zero. It is also known that the thickness of the boundary layer is inversely proportional to the velocity of the moving fluid. The reduced velocities within the boundary layer reduce the convective transfer of heat from the flowing fluid to the surrounding surface, or visa versa. The transfer of heat becomes dominantly by conduction as the surrounding surface is approached. The conductive heat transfer is much slower then the convective heat transfer in gases, such as air. The combined effects of the conductive heat transfer and the reduced convective heat transfer within the boundary layer is known as the gas side heat transfer coefficient. In the present invention, the surrounding surfaces are the walls of the combustion chamber 18, and the velocities are the residual velocities arising from the incoming flow of air through the intake valve ports 26, 28, 30.

It is known that the residual velocities increase as the volume in the combustion chamber 18 decreases and the pressure increases as a result of movement of the piston 15 within the cylinder bore 14 causing the boundary layer thickness to decrease. The boundary layer, established during the intake stroke, influences the rejection of heat from the combustion chamber 18 throughout the subsequent compression, expansion, and exhaust strokes. Any reduction in the initial residual velocities result in proportionally thicker boundary layers throughout subsequent compression, expansion, and exhaust strokes. Therefore, the transfer of heat from the contents of the combustion chamber 18 to the walls of the combustion chamber 18 is reduced.

It can be observed that the larger cross-sectional areas of the intake ports 26, 28, 30 reduces the velocity of the intake air providing a reduced residual velocity of the air in the combustion chamber 18. In the preferred embodiment, the mean intake velocity is less than about 4.3 times the mean velocity of the piston 15. In a conventional engine with intake valve ports less than about 69% of the total combined cross-sectional area of the intake and exhaust valve ports, the mean intake velocity is greater than about 4.3 times the mean velocity of the piston. The mean intake velocity in a conventionally designed engine is more typically approximately 6.0 times the mean piston velocity.

Due to the enlarged cross-sectional areas of the intake valve ports 26, 28, 30, the pumping work necessary during the intake stroke of an internal combustion engine is reduced. Conversely, the pumping work necessary during the exhaust stroke of an internal combustion engine is increased such that the total pumping work is greater than that of a conventional internal combustion engine. However, the reduction of heat rejection from the combustion chamber 18 into the surrounding structures results in more power during the expansion stroke and hotter exhaust. The additional power resulting from this effect substantially balances the additional power required to supply the pumping work at rated speeds. At reduced loads and/or speeds, the additional power resulting from the reduction in heat rejection provides an overall gain of power for the engine after substantially balancing the power needed during the pumping work of the intake and exhaust strokes. The hotter combustion chamber gases provide an increase in thermal efficiency thereby reducing the fuel consumption of the internal combustion engine. In a turbocompound engine, the hotter exhaust increases the exhaust energy recovery effectiveness and provides an overall improvement in engine efficiency. The reduction of heat rejection of the cylinder head 16, the cylinder block 12, and the piston 15 provides an additional benefit of allowing the use of a smaller radiator for cooling the engine.

In view of the above, it is apparent that the present invention provides a means to reduce heat rejection thereby increasing the thermal efficiency in an internal combustion engine.

Other aspects, objects, and advantages of this invention can be obtained from a study of the illustrations, the disclosure, and the appended claims.

We claim:

1. A cylinder head (16) adapted for use in an internal combustion engine (10) for the reduction of heat rejection, said cylinder head used in combination with an engine cylinder, said cylinder head and engine cylinder combination comprising:

only one exhaust valve port (66); and only three intake valve ports (26,28,30).

2. The cylinder head (16) as in claim 1, wherein the exhaust valve port (66) has an effective cross-sectional area and the intake valve ports (26,28,30) have an effective cross-sectional area which is larger than 69% of the combined cross-sectional area of the intake and exhaust valve ports (26,28,30,66).

3. The cylinder head (16) as in claim 1, wherein the exhaust valve port (66) has an effective cross-sectional area and the intake valve ports (26,28,30) have an effective cross-sectional area which is 75% of the combined cross-sectional areas of the intake and exhaust valve ports (26,28,30,66).

4. An internal combustion engine (10) having a cylinder block (12) defining a bore (14), a cylinder head (16) attached to the cylinder block (12) in closing relation to the bore (14), a piston (15) reciprocally mounted in the cylinder bore (14) and defining with the cylinder block (12) and the cylinder head (16) a variable volume combustion chamber (18), intake valve means (62) for admitting a constituent of a combustible mixture into the combustion chamber (18), exhaust valve means (74) for releasing exhaust gas from the combustion chamber, comprising:

only one exhaust valve port (66); and only three intake valve ports (26,28,30).

5. The internal combustion engine (10) as in claim 4, wherein the exhaust valve port (66) has an effective cross-sectional area and the intake valve ports (26,28,30) have an effective cross-sectional area which is larger than 69% of the combined cross-sectional area of the intake and exhaust valve ports (26,28,30,66).

6. The internal combustion engine (10) as in claim 4, wherein the exhaust valve port (66) has an effective cross-sectional area and the intake valve ports (26,28,30) have an effective cross-sectional area which is 75% of the combined cross-sectional areas of the intake and exhaust valve ports (26,28,30,66).

* * * * *